US011305965B2

(12) United States Patent
Lindegger

(10) Patent No.: US 11,305,965 B2
(45) Date of Patent: Apr. 19, 2022

(54) ELEVATOR WITH SAFETY CHAIN OVERLAY CONTROL UNIT WITH A SAFETY PLC SEPARATELY MONITORING VARIOUS SAFETY SWITCHES FOR INCREASING A SAFETY INTEGRITY LEVEL

(71) Applicant: Inventio AG, Hergiswil (CH)

(72) Inventor: Urs Lindegger, Ebikon (CH)

(73) Assignee: INVENTIO AG, Hergiswil NW (CH)

( * ) Notice: Subject to any disclaimer, the term of this patent is extended or adjusted under 35 U.S.C. 154(b) by 632 days.

(21) Appl. No.: 16/317,227

(22) PCT Filed: Jul. 3, 2017

(86) PCT No.: PCT/EP2017/066452
§ 371 (c)(1),
(2) Date: Jan. 11, 2019

(87) PCT Pub. No.: WO2018/010991
PCT Pub. Date: Jan. 18, 2018

(65) Prior Publication Data

US 2019/0300337 A1 Oct. 3, 2019

(30) Foreign Application Priority Data

Jul. 14, 2016 (EP) ..... 16179445

(51) Int. Cl.
*B66B 5/02* (2006.01)
*B66B 5/00* (2006.01)
*B66B 13/22* (2006.01)

(52) U.S. Cl.
CPC ..... *B66B 5/027* (2013.01); *B66B 5/0031* (2013.01); *B66B 5/028* (2013.01); *B66B 13/22* (2013.01)

(58) Field of Classification Search
CPC ..... B66B 5/0031; B66B 5/02; B66B 5/0006; B66B 5/005; B66B 5/0093; B66B 5/024; B66B 13/24; B66B 5/028
See application file for complete search history.

(56) References Cited

U.S. PATENT DOCUMENTS 5,107,964 A * 4/1992 Coste ..... B66B 13/24 187/280
6,173,814 B1 1/2001 Herkel et al.
(Continued)

FOREIGN PATENT DOCUMENTS

EP 1905720 A1 4/2008
EP 2457860 A2 5/2012

*Primary Examiner* — Marlon T Fletcher
(74) *Attorney, Agent, or Firm* — William J. Clemens; Shumaker, Loop & Kendrick, LLP

(57) ABSTRACT

An elevator has a drive unit displacing an elevator car in an elevator hoistway, an elevator controller controlling operation of the drive unit, multiple safety switches switchable upon occurrence of safety relevant events, and a safety chain overlay control unit including a safety PLC. The PLC has first connectors connected to first safety switch contacts and second connectors connected to second safety switch contacts. The PLC monitors a current safety status of the elevator and identifies a safety critical status by detecting when at least one of the safety switches changes its switching state and comparing the current switching states of the first and second safety switches. The PLC interrupts a main energy supply to the drive unit in response to the safety critical status of the elevator. Comparing switching states of the safety switches connected to the first and second connectors also enables detecting faulty safety switches.

16 Claims, 3 Drawing Sheets

11 DRIVE UNIT 12 BRAKE 13 ELEVATOR CONTROLLER 20 SAFETY CHAIN
31 SAFETY CHAIN OVERLAY CONTROL UNIT 43 SAFETY PLC
55 DOOR ZONE SWITCH 57 MAIN POWER SUPPLY UNIT
59 UNINTERRUPTIBLE POWER SUPPLY 65 SAFETY RELAY

(56) References Cited

U.S. PATENT DOCUMENTS

| | | | | |
|---|---|---|---|---|
| 8,820,482 | B2 | 9/2014 | De Coi et al. | |
| 2010/0032246 | A1* | 2/2010 | Kattainen | B66B 1/30 187/305 |
| 2015/0053508 | A1* | 2/2015 | Kattainen | B66B 5/00 187/289 |
| 2017/0001833 | A1* | 1/2017 | Lustenberger | B66B 13/22 |
| 2017/0313548 | A1* | 11/2017 | Nakari | B66B 5/00 |
| 2018/0282123 | A1* | 10/2018 | Raassina | H02P 29/0241 |
| 2019/0202663 | A1* | 7/2019 | Camenzind | B66B 5/02 |
| 2019/0300337 | A1* | 10/2019 | Lindegger | B66B 5/0031 |
| 2020/0207574 | A1* | 7/2020 | Hosemann | B66B 5/0031 |
| 2020/0283266 | A1* | 9/2020 | Sonnenmoser | G05B 9/02 |
| 2020/0325000 | A1* | 10/2020 | Nakari | H02J 9/062 |

* cited by examiner

5 ELEVATOR CAR
7 COUNTERWEIGHT
11 DRIVE UNIT
13 ELEVATOR CONTROLLER
17 SAFETY SWITCHES
19 LANDING DOOR SWITCHES
23 LADDER PRESENCE SWITCH
29 CAR DOOR SWITCH
31 SAFETY CHAIN OVERLAY CONTROL UNIT
41 MAIN CONTACTOR
43 SAFETY PLC

11 DRIVE UNIT 12 BRAKE 13 ELEVATOR CONTROLLER 20 SAFETY CHAIN
31 SAFETY CHAIN OVERLAY CONTROL UNIT 43 SAFETY PLC
55 DOOR ZONE SWITCH 57 MAIN POWER SUPPLY UNIT
59 UNINTERRUPTIBLE POWER SUPPLY 65 SAFETY RELAY

ELEVATOR WITH SAFETY CHAIN OVERLAY CONTROL UNIT WITH A SAFETY PLC SEPARATELY MONITORING VARIOUS SAFETY SWITCHES FOR INCREASING A SAFETY INTEGRITY LEVEL

FIELD

The present invention relates to an elevator in which safety switches such as a car door switch and several landing door switches are monitored for securing safety of an elevator operation.

BACKGROUND

Elevators are generally applied for transporting passengers or goods between different levels or floors in a building. Therein, an elevator cabin or elevator car is generally displaced vertically within an elevator hoistway using a drive unit. The elevator hoistway is sometimes also referred to as elevator well or elevator shaft. The drive unit typically comprises a drive engine and a brake. The drive engine may displace for example a suspension and traction member (STM) arrangement typically comprising a plurality of ropes or belts which support the elevator car. The brake may securely and rapidly decelerate a motion of the elevator car for example in an emergency case.

In order to secure a safe operation of the elevator, various safety measures generally have to be monitored. For example, it has to be guaranteed that the elevator car is not unintendedly displaced as long as any passengers may enter or leave the car through opened car doors and landing doors. For such purpose, each car door and each of a plurality of landing doors provided at the elevator hoistway typically at each level or floor serviced by the elevator is provided with a safety switch such as a car door switch or a landing door switch. Therein, a car door switch is used for monitoring an opening state of the car door and shall generally be closed only when the car door is closed. Similarly, a landing door which is used for monitoring a single one of the plural landing doors and shall generally be closed only when this landing door is closed.

Conventionally, all car door switches and landing door switches of an elevator are electrically connected in series such as to form a safety chain. Such safety chain as an entirety is closed only if all of the safety switches included therein are closed and the safety chain is opened as soon as at least one of the safety switches comes into an open state. In conventional elevator systems, a switching state of the safety chain is generally monitored by an elevator control. The elevator control shall prevent or stop any motion of the elevator car as long as the safety chain is in an open switching state indicating that at least one of the car doors and landing doors is currently opened.

Exceptions from such general rules may be allowable under specific conditions in order to enable for example re-levelling of the car or pre-opening of car and/or landing doors. Therein, relevelling may be understood as a process of slightly adjusting a current position of the elevator car upon positional changes occurring as a result of e.g. significant load being suddenly added or removed from the car. Pre-opening of car and/or landing doors may be applied shortly before the elevator car reaches a final destination level in order to accelerate a boarding or evacuation process of the elevator car.

While the elevator control shall generally monitor a current safety status of the elevator by for example continuously or repeatedly checking an opening state of the elevator's safety chain and prevent or stop any elevator motion upon a safety critical status being identified, official regulations in some countries (such as e.g. some Asian countries) do not stipulate an implementation how an energy supply to the elevators drive unit is necessarily interrupted thereby forcing the drive engine to stop operation and activating the brake upon the safety critical status being identified. Accordingly, it could happen that e.g. the elevator car is moved away from a floor despite a car door or landing door being currently open. Such unintended car movement may pose a hazard to passengers entering or leaving the elevator car.

Safety add-on devices have been developed for improving the safety level of an elevator. Such add-on devices may be supplemented or retrofitted into an existing elevator system and typically comprise additional safety contacts to be added into the elevator's safety chain in order to avoid for example unintended car movement. The add-on devices are typically adapted for monitoring a switching state of the safety chain and to, upon identifying a critical safety status, initiate stopping the drive unit. Optionally, re-levelling and/or pre-opening may be allowed using additional sensors and additional logics within an add-on device.

However, such conventional add-on device may suffer from disadvantages. For example, in order to enable retrofitting of an existing elevator system, the add-on device may have to be specifically designed and adapted to the features and characteristics of this elevator system. Accordingly, for each type of existing elevator system, a specific type of add-on device may have to be developed. This may require high development efforts, particularly as the add-on device is typically composed of hard-wired electric components. Furthermore, electrical connections and wiring between components of the existing elevator system and the add-on device generally have to be adapted and adjusted specifically to each other. This may induce substantial costs and work efforts upon retrofitting an elevator system and requires a high skills and training of the people. Additionally, conventional add-on devices might not satisfy steadily increasing safety requirements as ruled for example by present or future official regulations.

U.S. Pat. No. 8,820,482 B2 describes an elevator monitor for and drive safety apparatus. U.S. Pat. No. 6,173,814 B1 discloses an electronic safety system for elevators having a dual redundant safety bus.

There may be a need for an elevator and an add-on device referred to hereinafter as "safety chain overlay control unit" for an elevator overcoming at least some of the above-mentioned deficiencies of conventional elevators and/or add-on devices. Particularly, there may be a need for an elevator and a safety chain overlay control unit allowing monitoring of safety relevant events and preventing any hazardous elevator operations upon identifying a safety critical status of the elevator with a very high safety level and/or with minimum efforts for adapting the safety chain overlay control unit to specific characteristics of other components of the elevator system. Furthermore, there may be a need for a method for modernizing an existing elevator such as to increase its safety level with relatively low costs and/or efforts.

SUMMARY

According to a first aspect of the present invention, an elevator comprising a drive unit, an elevator controller, multiple safety switches and a specific safety chain overlay control unit is proposed. The drive unit is adapted for effectuating displacing an elevator car in an elevator hoistway. The elevator controller is adapted for controlling an operation of components of the drive unit such as a drive engine and/or a brake. The multiple safety switches are switchable upon occurrence of safety relevant events such as opening of a car door and/or a landing door. The safety chain overlay control unit comprises a safety PLC (programmable logic controller). Therein, the safety PLC comprises first connectors via which it is connected to contacts of at least one first safety switch being provided as one of a single first safety switch and a plurality of first safety switches connected in series to form a first safety chain. The safety PLC further comprises second connectors via which it is connected to contacts of at least one second safety switch being provided as one of a single second safety switch and a plurality of second safety switches connected in series to form a second safety chain. The safety PLC is adapted to monitoring a current safety status of the elevator and identifying a safety critical status of the elevator based on detecting when at least one of the first and second safety switches changes its switching state and based on comparing a current switching state of the at least one first safety switch with a current switching state of the at least one second safety switch. Therein, the safety PLC is adapted to cause interruption of a main energy supply to the drive unit upon identifying the safety critical status of the elevator.

According to a second aspect, the invention provides a safety chain overlay control unit for an elevator. Therein, the elevator comprises a drive unit, an elevator controller and multiple safety switches which are adapted as indicated in the preceding paragraph. The safety chain overlay control unit comprises a safety PLC which is adapted as stated above with respect to the first aspect of the invention and which is suitably electrically connected to the first and second safety switches of the elevator. Such safety chain overlay control unit may be retrofitted into an existing elevator in order to modernize it.

According to a third aspect, the invention proposes a method for modernizing an existing elevator. Therein, the elevator comprises a drive unit, an elevator controller and multiple safety switches which are adapted as indicated in the preceding paragraph. The method comprises providing a safety chain overlay control unit according to an embodiment of the above second aspect of the invention, connecting the first connectors of the safety PLC to contacts of at least one first safety switch being provided as one of a single first safety switch and a plurality of first safety switches connected in series to form a first safety chain and connecting the second connectors of the safety PLC to contacts of at least one second safety switch being provided as one of a single second safety switch and a plurality of second safety switches connected in series to form a first safety chain.

Ideas underlying embodiments of the present invention may be interpreted as being based, inter alia and without restricting the scope of the invention, on the following observations and recognitions.

As elevators may be used for transporting persons, very high safety levels have to be secured during their operation. However, official safety regulations differ throughout the world. For example, in some countries or regions, no compulsory interruption of an energy supply to an elevator drive unit as a reaction to e.g. an unintended car movement is required by local regulations. For example, in some elevators in some Asian countries, a closing state of each of a plurality of landing doors as well as of a car door is monitored by associated door switches and these door switches are connected in series to form a safety chain. An elevator controller monitors this safety chain and is adapted to stop operation of an elevator drive unit upon detecting an opening of this safety chain in order to thereby avoid unintended movement of the elevator car during one of the doors being opened. However, such avoiding of unintended car movement is controlled by the elevator controller only and in many cases no compulsory interruption of energy supply to the drive unit to thereby stop the drive engine and activate the elevators brakes is implemented in order to, for example, be able to still allow specific actions such as re-levelling of the elevator car or pre-opening of doors.

As indicated above, it may be intended to increase a safety level of existing elevators. For example, it may be intended to modernize an existing elevator such that it then fulfils the high safety requirements as ruled for example in the European norm EN-81. For such purposes, add-on devices have been developed. Such add-on device may be included into an existing elevator in addition to the existing elevator controller to thereby increase the elevator's safety level. An example of a conventional add-on device is offered by the firm Variotech (Austria) and technical details of such add-on device may be obtained at https://variotech.com/produkte/ena3-unintended-car-movement/.

Therein, conventional add-on devices typically comprise a hard-wired circuitry which is specifically adapted for cooperating with components of the existing elevator. The add-on device is then typically connected to, for example, the safety chain of the elevator via hard-wiring. Furthermore, the add-on device may be included into a circuitry of a main energy supply unit to the drive unit of the elevator or may suitably interact with such main energy supply unit such as to be able to interrupt energy supply upon detecting a safety critical status of the elevators. Thereby, for example an unintended car movement protection with a high level of safety may be implemented.

However, conventional add-on devices with hard-wired electromechanical components used to build-up their circuitry are complex in their design and costly to fabricate and/or a specific type of add-on device may typically be used for only one specific type of elevator and adapting such add-on device to another type of elevator may be elaborate and expensive.

It is therefore proposed herein to provide a new type of add-on device referred to herein as "safety chain overlay control unit". Such safety chain overlay control unit may be used for modernizing existing elevators in order to thereby increase their safety level, preferably in accordance with modern safety regulations such as the newest EN-81 standards. Therein, the safety chain overlay control unit does not or at least not only include hard-wired electromechanical components but comprises a safety programmable logic controller (PLC) which may be programmed for monitoring various types of input data and for initiating suitable reactions by outputting adequate output data.

The term "PLC" typically refers to a digital computer used for automation of typically industrial electromechanical processes, such as controlling various types of machinery. Therein, PLCs may be designed for various arrangements of digital and/or analogue inputs and outputs. Before the invention of PLCs, control, sequencing and/or safety interlock logic in industrial processes were mainly composed of relays, cam timers, drum sequencers and dedicated closed-loop controllers. However, as in conventional devices such as e.g. conventional add-on devices for elevators, a complex arrangement often including hundreds or even thousands of such electromechanical components was necessary to implement a required circuitry. Furthermore, a process for updating existing device models or adapting device models to various purposes was very time-consuming and expensive, as technicians needed to specifically rewire all electrical components to change their operational characteristics.

In order to avoid the complexity and costs associated therewith, programmable digital computers are used in modern PLC controllers in order to enable suitably adapting a control of industrial processes. Modern PLCs may be programmed in a variety of manners, from a relay-derived ladder logic to various programming languages. Newest PLCs may even be programmed using a so-called state logic which is a high-level programming language designed to program PLCs based on state transition diagrams.

While standard PLCs have been used for many years in various industrial appliances, they may generally not be used for satisfying very high safety requirements. Redundant PLC-based packages have been developed in order to improve safety integrity of systems as compared to a use of a single PLC. However, even such more sophisticated PLC-arrangements may in many cases not be sufficient for fulfilling increasingly high safety requirements as defined for example in the IEC 61508 standard Edition 2.0 defining "functional safety of electrical/electronic/programmable electronic safety-related systems" or the EN ISO 13849-1 standard.

Accordingly, a new type of PLCs has been developed, these PLCs typically being referred to as "safety PLCs" and being certified by independent notified bodies. There are fundamental differences between a safety PLC and a standard PLC for example in terms of architecture, inputs and outputs.

In terms of architecture, a standard PLC typically has one microprocessor which executes a program, a flash memory area for storing the program, a RAM (random access memory) for making for example calculations, ports for communication and I/O to detect and control a device or machine. In contrast, a safety PLC generally has two or more redundant microprocessors, flash and RAM that are continuously monitored by a watch dog circuit and a synchronous detection unit.

In terms of inputs, the inputs of standard PLCs typically provide no internal means for testing a functionality of an input circuitry. In contrast, safety PLCs generally have an internal "output" circuit associated with each input for the purpose of "exercising" the input circuitry. Generally, inputs are driven both high and low for very short cycles during runtime to verify their functionality.

In terms of outputs, a standard PLC typically has one output switching device, whereas a safety PLC digital output logic circuit typically generally contains a test point after each of two safety switches located behind an output driver and a third test point downstream of the output driver. Each of two safety switches is generally controlled by a unique microprocessor. If a failure is detected at either of the two safety switches due to for example switch or microprocessor failure, or at the test point downstream from the output driver, the operation system of the safety PLC will automatically acknowledge system failure. At that time, a safety PLC will default to a known state on its own, facilitating for example an orderly equipment shutdown.

Due to its specific provisions in its architecture, inputs and outputs, a safety PLC is well suited to, on the one hand, be used in an elevator safety add-on device guaranteeing very high safety standards and, on the other hand, enabling to adapt such add-on device's characteristics to various elevator types by suitably adapting the programming of the safety PLC.

Specifically for the application of such add-on device forming the safety chain overlay control unit, the safety PLC comprises connectors (which may also be referred to as circuit points or branch connections) via which it may be connected to contacts of one or more safety switches provided in the elevator for detecting safety relevant events.

In principle, the safety switches may be individually connected to the safety PLC. However, in such case, the number of connectors in the safety PLC would have to increase together with the number of safety switches to be connected thereto. It may therefore be preferable to interconnect a multiplicity of safety switches in series such as to form a safety chain and to connect end contacts of such safety chain to the connectors of the safety PLC.

Using the electrical connections between the connectors of the safety PLC and the safety switches, the safety PLC may monitor a current safety status of the elevator and may detect when the elevator comes into a safety critical status. Such monitoring and identifying the safety critical status may be based on detecting when one of the safety switches connected to the safety PLC individually or as comprised in a safety chain changes its switching state. In other words, the safety PLC may continuously or repeatedly check whether a safety switch or an entire safety chain switches for example from its usually closed state into an open state and, upon such state change, the safety PLC may assume that a safety critical status is present in the elevator.

Upon such identifying of the safety critical status, the safety PLC may then initiate suitable measures to securely prevent components of the elevator from effecting any safety critical actions.

Specifically, in order to realize a highest possible safety, the safety PLC is adapted to cause interruption of a main energy supply to the drive unit upon identifying the safety critical status of the elevator. Upon such interruption of the main energy supply, the drive engine comprised in the drive unit generally automatically stops operating, i.e. stops moving the elevator car. Furthermore, a brake comprised in the drive unit is generally adapted to automatically and effectively decelerate a moving elevator car upon energy supply interruption.

Accordingly, as an overall result, the safety PLC may supervise the current switching states of safety switches comprised in the elevator and, upon identifying a safety critical status, may induce interruption of the energy supply to the drive unit to thereby securely avoiding for example any unintended car movement during a safety critical situation.

However, while the safety chain overlay control unit comprising the safety PLC may be well suited for increasing the overall safety level of an elevator while allowing flexible adaption to existing elevator components, particularly upon modernizing an existing elevator, there may be a problem occurring from the fact that single safety switches may become faulty. For example, a safety switch may be short-circuited, may be by-passed or bridged, may be continuously held in its closed state due to switch contacts being unintendedly welded to each other, etc. With conventional add-on devices, faulty safety switches may usually not be detected and therefore there remains a risk that a safety critical situation is not correctly detected.

For example, the add-on device may not detect that a car door or a landing door is not correctly closed in cases where the associated door switch is for example blocked or short-circuited and does therefore not open upon opening of the door.

Therefore, it is proposed herein to provide the safety chain overlay control unit (serving as a supervising add-on device in an elevator according to an embodiment of the present invention) with a functionality which, at least in specific conditions, allows detecting faulty safety switches and to take into account such information upon monitoring the current safety status of the elevator and identifying the safety critical status of the elevator.

For such purpose, the safety PLC shall not only be provided with a single type of connectors but shall be provided with at least two types of connectors, i.e. with first connectors and second connectors. Therein, the first and second connectors do not necessarily differ in terms of the hardware of the connectors themselves but e.g. in terms of a data processing applied to signals or data received via these connectors. In other words, signals or data input at the various connectors shall be distinguishable and/or shall be processed in different manners. Particularly, the PLC shall be able to compare signals or data provided at the first connectors with those provided at the second connectors.

Specifically, the first connector(s) shall be connected to a first safety switch or a first safety chain comprising several first safety switches whereas the second connector(s) shall be connected to a second safety switch or a second safety chain comprising several second safety switches. In other words, one and the same PLC shall be able to obtain signals or data from different safety switches or safety chains, i.e. from the first safety switch or first safety chain, on the one hand, and from the second safety switch or second safety chain, on the other hand, via its first and second connectors. These signals or data represent switching states of the first and second safety switches.

The PLC shall then be able to compare the switching state indicated by the first safety switch(es) or the first safety chain with the switching state indicated by the second switch(es) or the second safety chain. The PLC shall then identify whether or not a safety critical status is currently present in the elevator based not only on the detected switching state(s) of the first and/or second safety switch(es) or chain(s) but also on a comparison of the switching states of each of the first and second safety switch(es) or chain(s).

Accordingly, an increased level of reliability may be achieved upon identifying a safety critical status in the elevator by the safety PLC not only monitoring a single type of safety switch or chain but monitoring at least two types of safety switches or chains and comparing the switching states thereof.

According to an embodiment, such monitoring and comparing of switching states of two types safety switches/chains may be particularly beneficial in cases in which the switching state of the at least one first safety switch and the switching state of the at least one second safety switch are correlated in a predetermined correlation manner due to structural characteristics of elevator components. In such cases, the safety PLC may be adapted to taking into account such predetermined correlation manner upon identifying a safety critical status of the elevator.

In other words, and as will be explained in more detail further below in relation to a specific embodiment, it may be known that for example a specific first safety switch and a specific second safety switch do not change their switching states completely independent from each other but are correlated in a predetermined manner due to structural characteristics of the elevator components. For example, it may be predetermined that, due to structural characteristics such as a mechanical linkage, the specific first safety switch and the specific second safety switch should always be in a same switching state as long as the elevator is for example in a specific operation status.

The knowledge about such predetermined correlation manner may be used by the PLC to check for example correct operation of each of a first and a second safety switch/chain. As soon as switching states indicated by the first and second safety switch/chain differ from each other while the elevator is in the specific operation status, the PLC knows that there must be an error in the indicated switching states due to, for example, a faulty safety switch. This information may then be taken by the PLC for identifying the safety critical status of the elevator. Accordingly, for example a faulty safety switch may be identified as a safety critical status and the safety PLC may cause interruption of the main energy supply to the drive unit thereupon.

According to a more specific embodiment, the at least one first safety switch comprises a car door switch and the at least one second safety switch comprises a plurality of landing door switches connected in series to form a safety chain.

In other words, the safety chain overlay control unit may distinguish between signals coming from a first safety switch formed by a car door switch as applied to the PLC's first connectors and signals coming from a second safety chain formed by a plurality of serially connected landing door switches as applied to the PLC's second connectors. The PLC may then compare the switching states indicated by the car door switch with those indicated by the landing door switches. At least in specific operational conditions of the elevator, the switching state of the car door switch should correlate to the switching state of a landing door switch in a predetermined manner.

For example, when the elevator car stops at one of the floors of the building, its car door is typically mechanically coupled to the landing door at this floor. Due to such mechanical coupling, both the car door and the landing door should open and close in a synchronous manner and the switching states of an associated car door switch and an associated landing door switch should always be the same as long as none of these safety switches is faulty. Knowing this predetermined correlation manner, faulty safety switches may be detected by comparing the switching states of the car door switch and of the safety chain comprising the associated landing door switch.

According to an even more specific embodiment of the elevator, the elevator car comprises at least one car door being provided with a car door switch, and a plurality of landing doors is provided at the elevator hoistway, each landing door being provided with a landing door switch. Therein, the safety PLC comprises at least one pair of first connectors being connected to contacts of the car door switch and the safety PLC furthermore comprises at least one pair of second connectors being connected to end contacts of a safety chain comprising the plurality of landing door switches connected in series. The safety PLC is then adapted to monitoring the current safety status of the elevator and identifying the safety critical status of the elevator based on detecting when at least one of the car door switch and landing door switches changes its switching state and based on comparing a current switching state of the car door switch with a current switching state of the at least one landing door switch.

In other words, the car door switch, on the one hand, and the safety chain comprising several landing door switches, on the other hand, are supervised by the safety PLC. However, the car door switch and the landing door switches are not combined in a common safety chain and are then supervised together, as in such configuration, it may not be distinguished whether the car door switch or one of the landing door switches opened when an opening of the entire safety chain is detected. Instead, the car door switch is monitored separately by being connected to the first connectors of the safety PLC whereas the safety chain comprising the landing door switches is monitored by being separately connected to the second connectors of the safety PLC. Switching states of the car door switch and of the landing door switch safety chain may then be compared in the safety PLC thereby possibly detecting any faulty safety switches.

While concepts underlying embodiments of the present invention may be applied to simple elevators in which the elevator car has only one car door, such concepts may be particularly beneficially applied to modern elevator designs in which the elevator car has several car doors. For example, the elevator car may have car doors at opposite sides thereby for example enabling access from each of opposing floors in a building. As another example, the elevator car may be a double car or double decker car comprising two car units arranged on top of each other such that each of the car units may be accessed from one of two vertically neighboring floors. In such arrangement, the elevator car may have two car doors, i.e. one at each of the car units, or may even have four car doors, i.e. opposing car doors at each of the car units.

Accordingly, according to an embodiment, the elevator car comprises at least two car doors, each of the car doors being provided with a car door switch. Furthermore, at least one set of landing doors, the set comprising a plurality of landing doors, is provided at the elevator hoistway, each landing door being provided with a landing door switch. Therein, landing door switches associated to one of the at least one set of landing doors are connected in series such as to form a specific safety chain called herein a set safety chain. The safety PLC then comprises at least two pairs of first connectors, each pair of first connectors being connected to contacts of one of the car door switches provided at one of the car doors.

The safety PLC further comprises at least one pair of second connectors, preferably at least two pairs of second connectors, each pair of second connectors being connected to end contacts of a set safety chain comprising the plurality of landing door switches.

In such configuration, it may be advantages that the number of pairs of first connectors corresponds to the number of car doors and the number of pairs of second connectors corresponds to the number of set safety chains.

In a more simplified wording, the elevator car may comprise several car doors each of which may be monitored with an associated car door switch. Furthermore, the hoistway is provided with a plurality of landing doors each of which may be monitored with an associated landing door switch. The landing door switches may be combined in sets of series connections for forming one or more set safety chains. In such situation, the safety PLC should comprise sufficient first connectors for connecting to each of the plural car door switches and should comprise sufficient second connectors for connecting to each of the set safety chains. With such configuration, the safety PLC may then continuously monitor each of the car door switches and set safety chains and suitably compare their switching states. Upon such comparison, the safety PLC may obtain valuable information about statuses of the monitored safety switches and, particularly, may be able to detect faulty safety switches.

According to an embodiment, the safety chain overlay control unit comprises at least one door zone switch, preferably at least two door zone switches, connected to the safety PLC. Such door zone switch may be adapted to determine a door zone presence status and communicate the door zone presence status to the safety PLC. Therein, the door zone presence status indicates whether or not the elevator car is presently in a predetermined door zone within the elevator hoistway.

In other words, preferably in addition to multiple landing and car door switches, an elevator may be provided with a door zone switch which may indicate whether or not the elevator car is currently within a predetermined door zone. Such predetermined door zone is typically a spatial interval within the elevator hoistway directly neighboring a final destination at which the elevator car shall stop in order to provide access to and from for example a floor. Such door zone may be for example a region of 20 cm adjacent to such final stop location. The door zone switch is generally activated as soon as the elevator car enters the door zone such that the door zone presence status output by the door zone switch indicates when the car is close to the final stop location. Such additional information may be used upon controlling the elevator operation.

Particularly, according to an embodiment, the safety PLC of the safety chain overlay control unit is adapted to taking into account the door zone presence status when identifying the safety critical status of the elevator.

In other words, the safety PLC may not only consider the switching states of the safety switches, particularly of door switches, but may additionally take into account the door zone presence status provided by one or more door zone switches when determining whether or not a safety critical status is present.

By additionally taking into account the door zone presence status, the safety chain overlay control unit may enable additional functionalities in a modernized elevator.

For example, re-levelling of the elevator car may be enabled. For such re-levelling, short distance displacements at low speed of the elevator car may be enabled by the safety chain overlay control unit although one of the monitored door switches indicates a currently opened door as long as the associated door zone switch indicates that the car is in the door zone and therefore close to its final destination. Accordingly, at such specific conditions, the safety PLC may be programmed to temporarily ignore one of its monitored safety switches being opened as long as the car is indicated to be within the door zone and may therefore not cause interruption of the main energy supply to the drive unit. However, as soon as the elevator car leaves the door zone and the elevator switch, respectively the door switch, is still opened, a safety critical status is assumed and interruption of the main energy supply is caused.

Alternatively, or additionally, the safety PLC may be programmed to enable a pre-opening functionality for the elevator. Again, the safety PLC may determine when the elevator car is in a door zone close to its final stop location and may only at such specific conditions allow further slowly displacing the elevator car while simultaneously the landing door and/or the car door is already opened and such opening causing changing the switching state of the associated door switches.

Particularly, according to an embodiment, the elevator may be specifically adapted such that, while the elevator car is in a predetermined door zone, a car door and a neighboring one of the landing doors are mechanically coupled to move, i.e. to open and close, synchronously. In such configuration, the safety PLC may be adapted to, when the door zone presence status is indicating that the elevator car is currently in a predetermined door zone within the elevator hoistway, monitoring the current safety status of the elevator and identifying the safety critical status of the elevator based on comparing a current switching state of the first safety switch being implemented as a car door switch with a current switching state of a safety chain including plural landing door switches including a landing door switch associated to a landing door located at the predetermined door zone. Thereby, the identification of the safety critical status may be based on a redundant 2-channel monitoring including monitoring of the car door switch, on the one hand, and monitoring of the landing door switch, on the other hand, and taking into account that both door switches shall normally operate synchronously.

In other words, the safety PLC may use the information provided by the door zone switch indicating that the elevator car is currently within the predetermined door zone for specifically testing an integrity of the car door switch and/or the landing door switch at the floor where the elevator car is currently stopping. Such specific testing is enabled due to the fact that when the elevator car is within a door zone, its car door and the landing door in the neighboring floor are generally mechanically coupled to each other. Due to such coupling, both doors may only open and close synchronously, i.e. the closing state of the doors is correlated in a predetermined correlation manner. This fact may be taken into account by the safety PLC when testing the integrity of the associated safety switches. Under normal operation conditions, the switching states of the monitored car door switch and of the monitored set safety chain comprising the associated landing door switch should always be the same. However, when the safety PLC detects that these switching states differ, i.e. the landing door switch indicates a closed state of the landing door whereas the car door switch indicates an open state of the car door, or vice versa, the safety PLC may assume that at least one of the monitored safety switches is faulty. Such recognition may be taken as indicating a safety critical status of the elevator and the safety PLC may then cause interruption of the main energy supply to the drive unit.

According to an embodiment, the safety chain overlay control unit further comprises a main power supply unit and an uninterruptible power supply unit (UPS). The main power supply unit is adapted for providing electric power to the safety PLC under normal operation conditions. The UPS is adapted for providing electric power stored in the UPS to the safety PLC upon failure of power supply from the main power supply unit.

In other words, an electric energy supply to the safety PLC may be secured in a redundant manner. The main power supply unit may be electrically connected for example to a power grid provided in the building housing the elevator and may provide electric power to the safety PLC as long as this power grid correctly functions. However, upon for example power failure in such grid, electric power may be provided to the safety PLC using the UPS. For such purpose, the UPS may comprise energy storage means such as a battery, a power capacitor, a fuel cell, an emergency backup generator or similar means. Thereby, the safety chain overlay control unit may be safeguarded against failures in power supply.

Particularly, it may be advantageous to electrically connect the main power supply unit and/or the UPS to the safety PLC not only with for example electric lines for power supply but to also provide electrical connections between the safety PLC and the main power supply unit and/or the UPS in order to enable supervising correct operation of these devices by the safety PLC. In other words, the safety PLC may continuously monitor the presence and/or integrity of the main power supply unit and/or the UPS via for example electrical diagnosis lines.

According to an embodiment, the safety PLC is adapted to, upon monitoring the current safety status of the elevator, applying a pulsed voltage to the safety switches.

In other words, the switching state of the monitored safety switches is preferably not determined based on a change in a DC voltage applied to the safety switches as is typically the case in conventional elevator controllers monitoring a safety chain. Instead, a pulsed voltage, i.e. a voltage the magnitude of which changes periodically, is applied to the safety switches and a change of such pulsed voltage is detected and taken as indicating whether or not a safety critical status is present in the elevator.

Thereby, for example the following advantages may be obtained: In conventional elevators where the elevator controller monitors only a DC voltage applied to a safety chain, erroneous monitoring results may be obtained when for example an external voltage is unintendedly applied to the safety chain as a result of e.g. electrical shorts or electrical by-passes. In such cases, a door switch may open but, due to the external voltage being applied, the elevator controller does not see a change in the voltage at the safety chain. Accordingly, the elevator controller does not stop normal operation of the drive unit and unintended car movements may be allowed.

In another scenario, the elevator controller may monitor a magnitude of an output voltage from a safety switch or a safety chain and may assume that the switch or chain is closed as long as such voltage is within specific limits. However, for example due to failures in safety switches or electrical connections between safety switches, electrical shorts or by-passes may occur such that, when a safety switch is for example opened, this opening does not automatically cause an increase in electrical resistance through the safety chain and does therefore not induce a significant change in the magnitude of the received voltage. Accordingly, malfunctions of safety switches may not be detected thereby limiting an overall safety level for the elevator.

In order to avoid such scenarios, the safety PLC may apply a pulsed, i.e. non-continuous, voltage to the safety switches for example at one end of the safety chain and may detect the voltage occurring at the opposite end of the safety chain. As long as such detected voltage has a same time-dependency as the applied voltage, it may be assumed that the safety chain is in its closed switching state. Such assumption may potentially be made independent of any magnitude of the detected voltage. Thereby, an overall safety level for the operation of the elevator may be increased.

According to an embodiment, the safety PLC may be adapted to fulfilling at least safety-integrity-level-2 (SIL-2) requirements. Preferably, the safety PLC is adapted to fulfilling safety-integrity-level-3 (SIL-3) requirements.

Safety-integrity-levels are defined for example in the international standard IEC 61508 as a relative level of risk-reduction provided by a safety function or to specify a target level of risk reduction. Therein, SIL-4 is the most dependable and SIL-1 the least. In safety PLCs, various measures may be taken to adapt their safety to fulfilling a specific safety integrity level. As elevators may transport persons, it is assumed that high SIL-requirements are to be fulfilled during their operation and it is therefore proposed to use a SIL-3 conform safety PLC in the safety chain overlay control unit.

Due to the elevated safety characteristics of its safety PLC, on the one hand, and due to the ability of testing an integrity of monitored safety switches connected to the safety PLC via different first and second connectors, i.e. via different channels, the entire safety chain overlay control unit may satisfy very high safety requirements, possibly up to SIL-3 safety requirements.

Furthermore, according to an embodiment, the safety switches are preferably connected to the safety PLC via electrical connections such as to fulfil official safety regulations with respect to material, isolation, creeping distances, separation and/or labelling of the connections.

In other words, for example a material and/or isolation applied for electrical lines interconnecting the safety switches and the safety PLC when including a safety chain overlay control unit into an existing elevator upon modernization thereof may be selected such as to fulfil ambitious official safety regulations. Similarly, creeping distances and/or separations between neighboring electrical lines may be selected such as to fulfil such safety regulations.

Accordingly, upon modernizing an elevator, previously existing electrical connections potentially not satisfying such safety regulations may be complemented or replaced applying modern safe electrical connection schemes. Accordingly, an overall safety level of the elevator after modernization is not only increased by including the safety chain overlay control unit but also by replacing less safe electrical connections by modern electrical connections.

It shall be noted that the applicant of the present application filed a similar patent application, this patent application having the application number EP 16177320 and the title "Elevator with safety chain overlay control unit comprising a safety PLC monitoring safety switches and mirroring a switching state to an elevator control". This patent application discloses details of an alternative elevator comprising an alternative safety chain overlay control unit and of an alternative method for modernizing an existing elevator using such safety chain overlay control unit. Some details of embodiments disclosed in the similar patent application may be transferred to or may be easily adapted for incorporation into embodiments described in the present application. The similar patent application shall be incorporated herein in its entirety by reference.

It shall be noted that possible features and advantages of embodiments of the invention are described herein partly with respect to an elevator, partly with respect to a safety chain overlay control unit to be used in an elevator and partly with respect to a method for modernizing an existing elevator. One skilled in the art will recognize that the features may be suitably transferred from one embodiment to another and features may be modified, adapted, combined and/or replaced, etc. in order to come to further embodiments of the invention.

In the following, advantageous embodiments of the invention will be described with reference to the enclosed drawings. However, neither the drawings nor the description shall be interpreted as limiting the invention.

The figures are only schematic and not to scale. Same reference signs refer to same or similar features.

DETAILED DESCRIPTION

Figure 1:
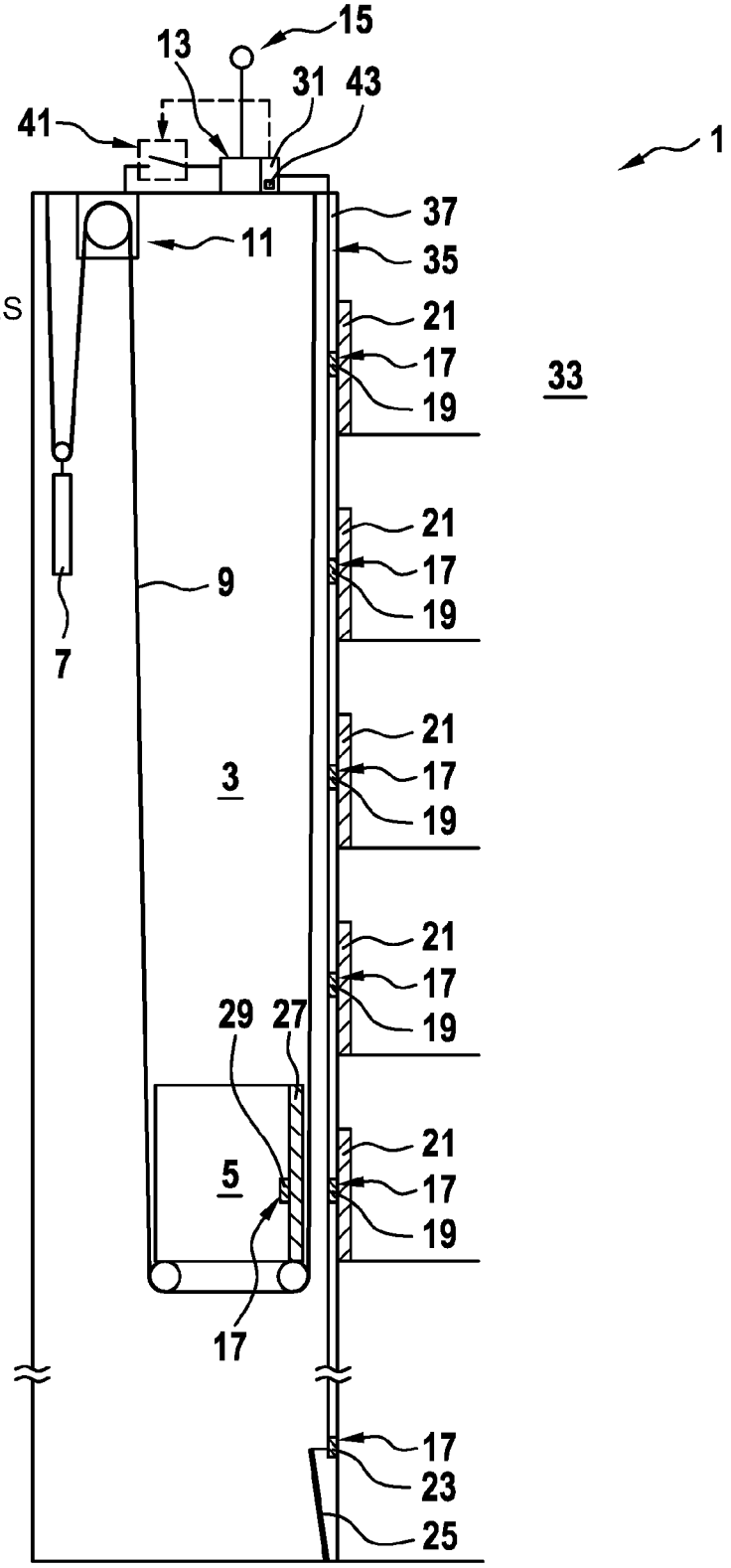
FIG. 1 shows an elevator according to an embodiment of the present invention.

FIG. 1 shows an elevator 1 according to an embodiment of the present invention. The elevator 1 comprises an elevator car 5 and a counterweight 7 which are both suspended by a multiplicity of ropes or belts forming a suspension traction member (STM) 9. The STM 9 may be displaced using a drive unit 11 in order to thereby effectuate displacing the elevator car 5 and counterweight 7 within an elevator hoistway 3 in a vertical direction. The drive unit 11 comprises a drive engine including e.g. an electric motor for rotatably driving a traction sheave. Furthermore, the drive unit 11 typically comprises brake means for decelerating a motion of the STM 9 in order to thereby stop the car 5 and counterweight 7 from moving.

An operation of the drive unit 11 is controlled by an elevator controller 13. Particularly, the elevator controller 13 controls or regulates a power supply coming from a power source 15 to the drive unit 11. Particularly, a power supply to the drive engine comprised in the drive unit 11 may be controlled. Furthermore, a power supply to the brake included in the drive unit 11 may be controlled wherein such brake is typically adapted such that upon power supply a braking action is released and at an interruption of the power supply, the braking action is activated.

The elevator 1 furthermore comprises landing doors 21 at each of multiple floors 33 of a building, such landing doors 21 opening and closing an access from a floor 33 to the elevator hoistway 3. Each of the landing doors 21 is provided with a safety switch 17 forming a landing door switch 19. Such landing door switch 19 is closed as long as the associated landing door 21 is closed.

Furthermore, the elevator car 5 comprises a car door 27 opening and closing an access to the elevator car 5. The car door 27 is provided with another safety switch 17 forming a car door switch 29.

While in the example shown in FIG. 1, the elevator car 5 comprises only one car door 27 with one car door switch 29, a car 5 may comprise more than one door. For example, the car 5 may comprise two doors 27 at opposing sides of the car 5. Or the car 5 may comprise several car units at various vertical levels, each having its own door 27 or doors 27. For example, a double decker car has two units at two levels. Each car door 27 may have its own car door switch 29 associated thereto.

Furthermore, a ladder 25 is provided close to a bottom of the elevator hoistway 3. Whether or not the ladder 25 is present and correctly stored is monitored with another safety switch 17 provided as a ladder presence switch 23. Further safety switches 17 may be provided in the elevator 1 for other purposes.

In a conventional elevator, all of such safety switches 17 are connected to the elevator control 13 such that the elevator control 13 may be informed about closing states of all landing doors 21 and of the car door 27 as well as of other features such as the correct storing of the ladder 25. Taking into account such information from the safety switches 17, the elevator controller may then suitably control the drive unit 11. However, increased safety requirements may not always be satisfied in such conventional elevators.

It is therefore proposed to provide a specific safety chain overlay control unit 31 to the elevator 1. Instead of being conventionally electrically directly connected to the elevator controller 13, all of the safety switches 17 may be electrically connected to such safety chain overlay control unit 31, for example via an electrical connection 35 formed by an electric line 37. Therein, the various safety switches 17 may be connected in series such as to form a safety chain. The safety switches 17 forming the car door switch 29 may be connected to the safety chain overlay control unit 31 via a travelling cable (not shown in FIG. 1 for simplicity of representation).

The safety chain overlay control unit 31 being connected to the various safety switches 17 may use the information provided by the safety switches 17 for monitoring a current safety status of the elevator 1 and identifying a safety critical status of the elevator based on detecting when one of the safety switches 17 changes its switching state. For such purpose, the safety chain overlay control unit 31 comprises a safety PLC 43. The safety chain overlay control unit 31 and its safety PLC 43 are adapted to interrupt a main energy supply to the drive unit 11 upon identifying a safety critical status of the elevator 1. For such purpose, a main contactor 41 (only schematically shown in FIG. 1) may be comprised in an electric connection between the elevator controller 13 and the drive unit 11. Alternatively, such main contactor 41 may be provided at a different location within an energy supply path between the power source 15 and the drive unit 11. The safety chain overlay control unit 31 may then cause such main contactor 41 to interrupt a power connection to the drive unit 11 as soon as a safety critical status, such as one of the landing doors 21 being opened, is detected in the elevator 1.

Details of a specific embodiment of a safety chain overlay control unit 31 and its cooperation with the elevator controller 13 and the safety switches 17 will now be explained with reference to FIG. 2.

Figure 2:
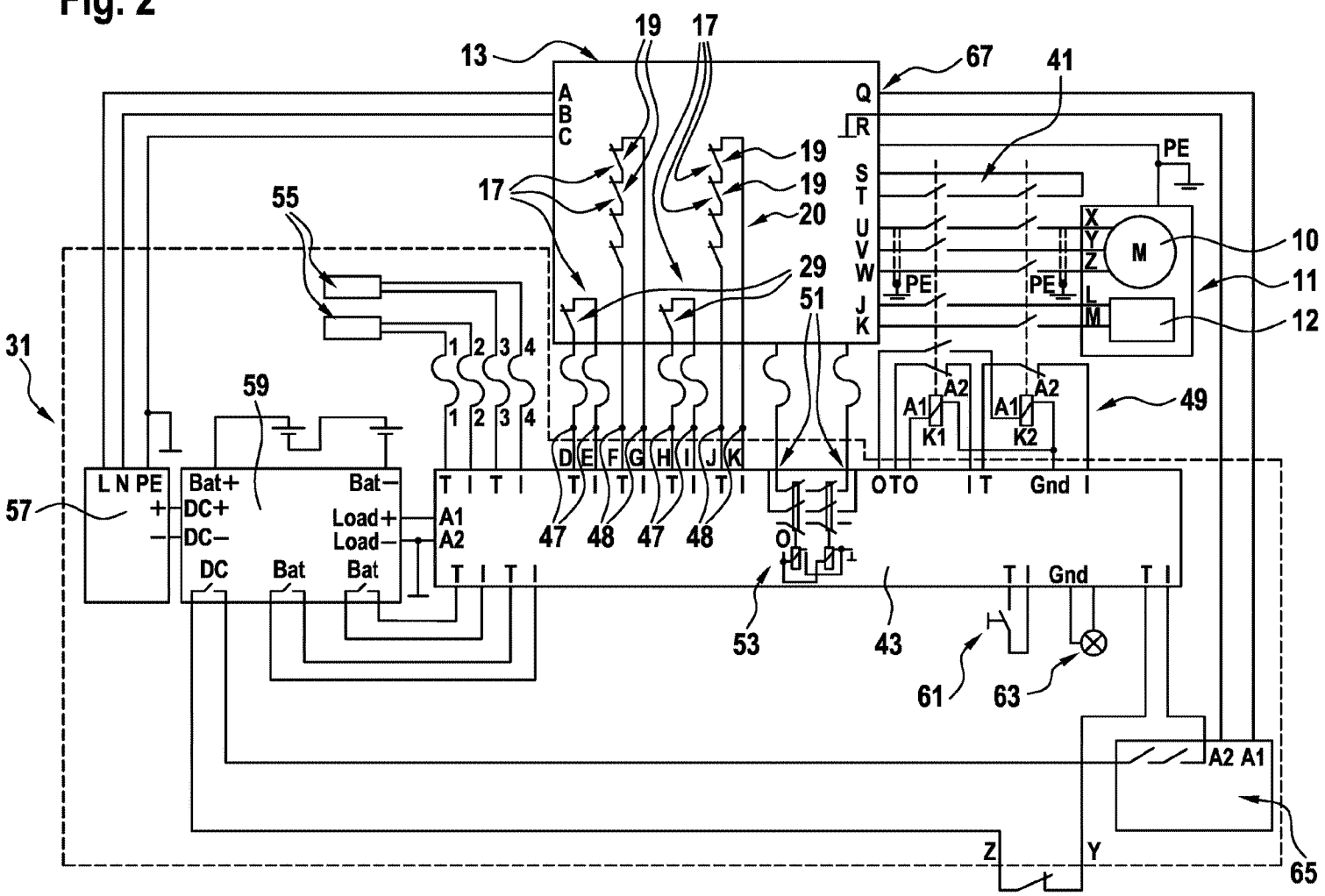
FIG. 2 shows a safety chain overlay control unit for an elevator according to an embodiment of the present invention.

In the exemplary embodiment shown in FIG. 2, the safety chain overlay control unit 31 is adapted for monitoring a safety critical status of an elevator 1 having two car doors 27, one car door 27 at each of opposing sides of the car 5. Each of the car doors 27 is provided with an associated car door switch 29 which is closed only when the car door 27 is in its closed state. Furthermore, landing doors 21 are provided at each of the floors 33, one landing door 21 being provided at each of opposing sides of the hoistway 3. Each landing door 21 is provided with an associated landing door switch 19. Again, the landing door switches 19 are closed only when the associated landing door 21 is in its closed state.

While the diagram shown in FIG. 2 discloses many details of the embodied safety chain overlay control unit 31 as well as of other components of the elevator that may be understood by those skilled in the art from the circuitry representation, only those features which are relevant for or correlated to the present invention shall be described in more detail.

The safety chain overlay control unit 31 follows state of the art methods of machinery industries as described for example in the standard EN ISO 13849-1. Instead of monitoring for example a voltage in a safety chain that needs to be interpreted as "doors are opened", as it is conventionally done for example by elevator controllers in existing elevators following more relaxed safety standards, it is proposed herein to directly connect the safety switches 17 forming for example landing door switches 19 and/or car door switches 29 to the safety chain overlay control unit 31 in order to enable direct monitoring of their switching states by such safety add-on device.

The safety chain overlay control unit 31 comprises a safety PLC 43 which may be certified as a safety controller in accordance for example with EN ISO 13849.

In the embodiment shown in FIG. 2, the safety PLC 43 comprises two pairs of first connectors 47 (indicated with D, E, H, I) and two pairs of second connectors 48 (indicated with F, G, J, K). The first connectors 47 are connected each to contacts of a first safety switch 17 formed by a respective one of the car door switches 29. The second connectors 48 are connected each to end contacts of safety chains 20 formed by a series connection of landing door switches 19. Therein, all landing door switches 19 provided at one side of the elevator hoistway 3 are serially connected in order to form one of the safety chains 20.

The safety PLC 43, due to its internal circuitry logics and/or due to its application-specific programming, is then adapted for monitoring the current safety status of the elevator 1 and identifying a safety critical status of the elevator 1 by supervising switching states of all safety switches 17, particularly of the car door switches 29 and of the safety chains 20 comprising the landing door switches 19.

Therein, the safety PLC 43 does not only continuously or repeatedly check current switching states of all these safety switches 17 but, additionally, also compares current switching states of the safety switches 17 connected to the first connectors 47, i.e. of the car door switches 29, with the current switching states of the safety switches 17 connected to the second connectors 48, i.e. of the landing door switches 19 comprised in the safety chain 20. Inter-alia upon such comparison, the safety PLC 43 may recognize for example not only when one of the safety switches 17 is opened thereby indicating a safety critical status of the elevator 1 in which for example the elevator car 5 should not be moved, but may also recognize whether for example one of the safety switches 17 is faulty thereby causing another type of safety critical status of the elevator 1.

Upon a safety critical status of the elevator 1 being identified based on the information obtained from the safety switches 17, the safety PLC 43 may control two redundant contactors 49. These contactors 49 are adapted to, upon such actuation, interrupt the power supply to the drive unit 11 and its drive engine 10 and brake 12 by suitably actuating or influencing the main contacts 41 which otherwise establishes the power supply between the elevator controller 13 and the drive unit 11. Accordingly, operation of the drive unit 11 is securely interrupted and any motion of the car 5 driven by the drive unit 11 is effectively stopped as soon as a safety critical status is identified.

Since the safety switches 17 are now connected to the safety chain overlay control unit 31 instead of to the existing elevator controller 13, the existing elevator controller 13 will generally no more get the required information for example about door closing states and should therefore refuse to operate as desired. Therefore, for example the information normally provided by the door switches 19, 29 generally needs to be re-created by the safety chain overlay control unit 31 and rewired into the existing elevator safety chain. This may be done by the safety PLC 43 emulating an overall switching state of the safety switches 17 and communicating such emulated overall switching state back to the elevator controller 13 using third connectors 51. In a specific implementation, this may be done by a safety relay 53 comprised in or controlled by the safety PLC 43, such safety relay 53 having its output contacts doing the same as the safety switches 17 do. Accordingly, the output third contacts 51 may be considered as "mirroring" the action of the safety switches 17 comprised in the safety chain 20 and may feed-back such information to the elevator controller 13. Upon receiving such fed-back information, the elevator controller 13 may operate in its normal manner.

The safety chain overlay control unit 31 shown in FIG. 2 furthermore comprises two redundant door zone switches 55. These door zone switches 55 are connected to further connectors of the safety PLC 43 and are adapted to determine a door zone presence status and communicate same to the safety PLC 43. Two door zone switches 55 are used to retrieve the door zone information in a redundant and therefore safe way. The safety PLC 43 can perform discrepancy checks to detect faulty door zone switches 55. Taking into account such door zone presence status, the safety PLC may control the interruption of the main energy supply (via controlling the contactors 49) and/or may emulate the fed-back information (via the third connectors 51) in a manner such as to enable additional functionalities such as re-levelling and/or pre-opening.

Furthermore, the safety chain overlay control unit 31 comprises a main power supply unit 57 and an uninterruptible power supply unit (UPS) 59. Furthermore, a manual start button 61, a status indication 63 and an additional safety relay 65 are provided. It should be noted that the safety chain overlay control unit 31 does not necessarily interrupt a power supply to the main contactors. A reason for this may be that such main contactors including their monitoring are not always being considered as safe enough in existing elevator controllers. Therefore, when the safety chain overlay control unit 31 detects a dangerous condition and identifies the safety critical status of the elevator, it preferably cuts the energy supply from the engine 10 and/or the brake 12 of the drive unit 11.

Furthermore, it shall be noted that other safety switches 17 than door switches 19, 29 may be used for removing power supply from those main contactors as well. Such other safety switches may comprise for example over-speed governor switches, safety gear switches, hoistway limit switches, etc. Since an implementation of the main contactors of existing elevators may be considered not to be safe enough, the safety chain overlay control unit may also monitor their coil voltage using a "tab to safety chain" 67.

Next, some possible implementations for further increasing a safety level in the elevator 1 by specifically adapting its safety chain overlay control unit 31 will be explained with reference to FIGS. 3 and 4. Therein, the safety PLC 43 is specifically adapted for realizing that the elevator 1 is in one of specific operation conditions such as the elevator car 5 being in a door zone and to then perform specific checks or comparisons for determining for example any faulty safety switches 17.

It may be mentioned that safety switches 17 may not only be faulty due to internal components or wirings being defective but also due to external defects such as broken interconnections between neighboring safety switches 17, isolation defects in a safety chain, etc. Such defects may result e.g. in safety switches 17 being short-circuited and/or being bypassed.

Figure 3:
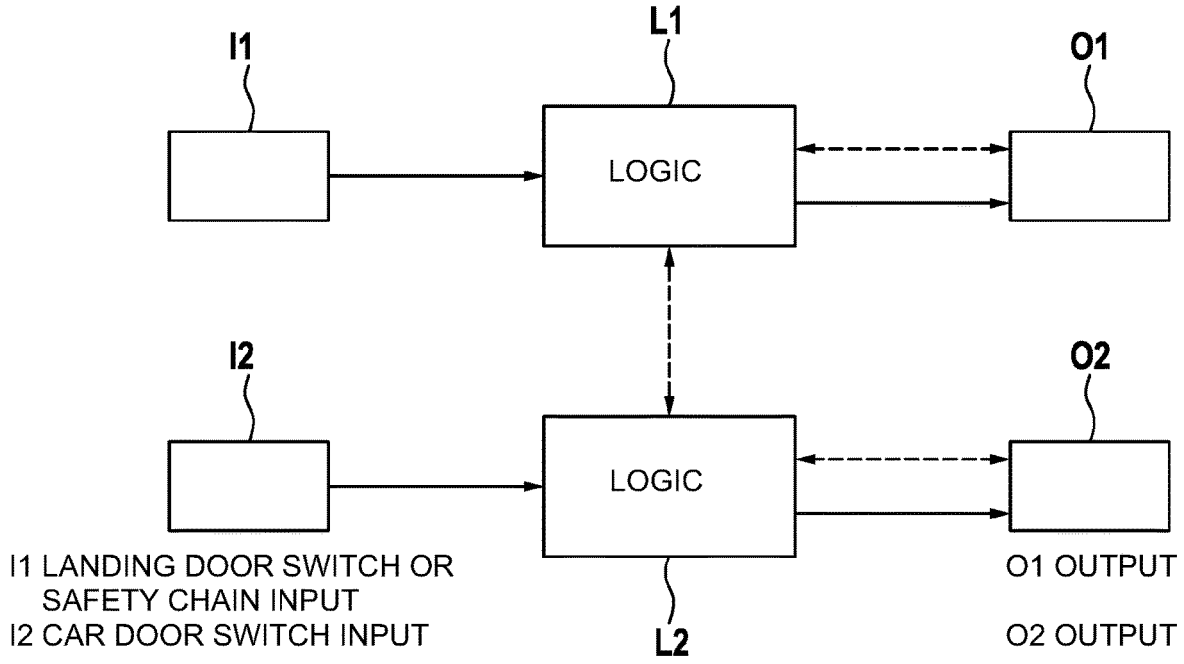
FIG. 3 shows a safety-related part of a control system to be implemented with the safety chain overlay control unit according to an embodiment of the present invention in a specific operation condition of the elevator.
Figure 4:
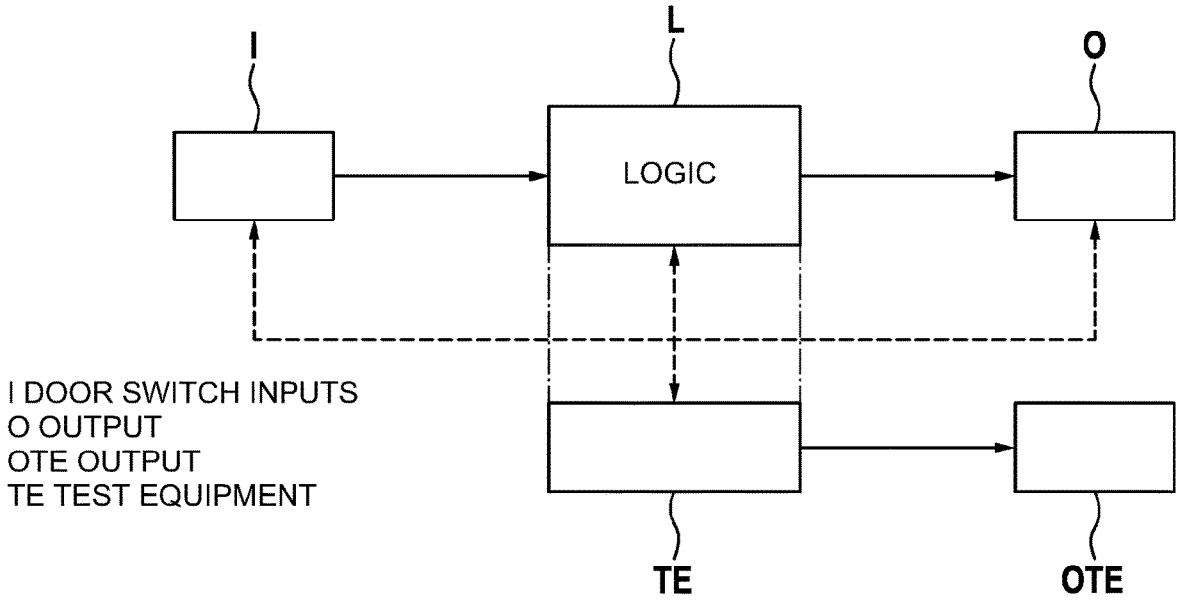
FIG. 4 shows a safety-related part of a control system to be implemented with the safety chain overlay control unit according to an embodiment of the present invention in another specific operation condition of the elevator.

FIG. 3 represents a safety-related part of control system (SRP/CS) applicable for implementing a safety function which may be enabled when the elevator 1 is in a door zone.

Inside the door zone, the elevator's car door 27 and the landing door 21 closely neighboring the current position of the elevator car 5 are generally mechanically linked and can therefore be considered as one single device. Accordingly, the associated car door switch 29 and the associated landing door switch 19 should change their switching states in a synchronous manner. As these door switches 29, 19 are connected to different ones of the first and second connectors 47, 48 of the safety PLC 43, a 2-channel architecture as defined in EN ISO 13849-1 may be applied.

In the SRP/CS shown in FIG. 3 for applying such architecture, I1 can be the input of the landing door switch 19 or the safety chain 20 comprising such landing door switch 19. I2 can be the input of the car door switch 29. The logics L1 and L2 are implemented in a 2-channel SIL-3-certified safety PLC 43. The safety PLC 43 then uses two outputs O1, O2 to control two main contactors and monitors them using their mechanically linked (or positively driven) normally-closed (NC) contacts.

Since this is a 2-channel system, cross checking may be possible and therefore fails can be detected (diagnostic coverage). SIL-1 to SIL-3 may be achieved by such architecture. If the elevator car 5 leaves the door zone with open doors 21, 27, the safety function triggers an unintended car movement event and removes power from the two contactors. Such events may be stored nonvolatile in the safety PLC 43 and may require a manual reset from a competent person.

It may be mentioned as a side effect that it is a normal procedure to open a landing door 21 in order to enter the car roof for inspection. This can happen while the car stands in the door zone. Since all landing doors 21 are wired in series, the safety chain overlay control unit 31 cannot differentiate this landing door 21 from the one mechanically linked to the car door 27. It could therefore interpret it as a broken car door switch 29 that is always closed. To enable both monitoring landing door switches 19 but not triggering errors when the service personal enters the car roof, the safety chain overlay control unit 31 may accept opening the landing door 21 inside the door zone without opening the car door 27, at least under certain circumstances. Since every regular trip tests the car door switch 29, the required test rate to assure the expected safety level is generally much lower. Therefore, a car door error can be triggered when this happens for example 10 times in a sequence. This counter will then be reset when the car door switch 29 gets successfully tested. This is the case when both car door 27 and landing door 21 open while the car 5 is in the door zone.

Next, the safety function for preventing a movement of the elevator car 5 with open doors 21, 27 when being outside the door zone will be explained with reference to FIG. 4.

When being outside the door zone, the car door 27 and the landing door 21 are no more mechanically linked. However, the elevator 1 offers a lot of diagnostic possibilities since the doors 27, 21 are of automatic type. Accordingly, a correct function of door switches 29, 19 may be tested frequently. Therefore, the EN ISO 13849-1 architecture for category-2 can be considered as shown in FIG. 4.

Therein, the block "I" may contain the door switch inputs from the car door switch 29 or the landing door switch 19. "L" is the logic. TE is a test equipment and OTE is an output of the test equipment, all being implemented in the SIL-3-certified safety PLC 43. O and OTE are the outputs of this SRP/CS that can be further used in the safety PLC's application. Although only a single-channel architecture is applied, up to SIL-2 may be reached by such architecture.

Finally, some possible advantages of embodiments of the present invention shall be summarized. Overall, since the safety chain in an elevator is generally a complex wiring and may differ between various existing elevator controllers, an elevator as proposed herein comprising the specific safety chain overlay control unit 31 may be significantly safer compared to prior art elevators. There may be various reasons for such improved safety.

For example, connecting the safety switches forming door switches to the safety chain overlay control unit 31 may result in an easy, new and/or standardized wiring that may be used in the parts where safety is a must. A wiring with variations and adaptations to the existing elevator controllers may then be done in a part that is less safety-relevant.

Door switches may usually be by-passed to allow pre-opening and/or re-levelling. This could create wrong input signals to conventional safety add-on devices and may cause faulty behavior. Having the safety switches directly wired to the safety chain overlay control unit proposed herein does not have such negative side effects.

Finding a correct point in an existing elevator controller to be connected to a conventional safety add-on device may require high skills and product know-how. Therefore, there may be some risk that it might go wrong. Adding the safety switches using new wiring to the safety chain overlay control unit proposed herein may be much easier verified.

There may be various defects such as isolation or electronics defects that may apply a voltage to a safety chain and therefore fooling the safety overlay provided by a conventional safety add-on device. A safety PLC to be comprised in the safety chain overlay control unit proposed herein may use instead of a constant safety chain voltage a pulsed voltage that needs to be received by an input of such safety PLC. Isolation defects applying a voltage to safety switches may therefore be detected by the safety chain overlay control unit.

Connecting the safety switches directly to the safety chain overlay control unit may allow using new wiring fulfilling requirements for safety such as selecting a correct material, isolation, creeping distances, separation, labelling, etc.

If the safety switches are not directly connected to the safety chain overlay control unit, an ability to know the current status of for example doors may be lost when another safety switch in the series connection forming the safety chain has opened. Connecting the safety switches forming the door switches directly to the safety chain overlay control unit allows for knowing the current door status at all times.

Overall, using the safety chain overlay control unit 31 proposed herein, an existing elevator 1 may be modernized and its safety may be increased, possibly even enabling additional functionalities such as re-levelling of the car 5 or pre-opening of elevator doors 21, 27.

Additionally to these possible advantages, separately monitoring car door switches 29 and landing door switches 19 connected to different first and second connectors 47 and 48 may result in the following advantages:

- a safety integrity level of up to SIL-3 may be assigned for unintended car movement detection due to using a 2-channel architecture according to EN ISO 13849.
- a safety integrity level of up to SIL-2 may be assigned for preventing a movement with open doors outside the door zone due to using the EN ISO 13849 architecture for category 2.
- easy diagnostics of door switch failure is enabled since the door switches are connected directly to the safety PLC.
- following the EN ISO 13849-1 standard allows easy determination of a Performance Level (corresponding to a SIL) demonstrating that the risks are enough mitigated. In contrast hereto, following just EN81-requirements and therefore state-of-the-art generally leads to using the standard elevator controller for the safety chain monitoring and therefore no SIL.

Finally, it should be noted that the term "comprising" does not exclude other elements or steps and the "a" or "an" does not exclude a plurality. Also, elements described in association with different embodiments may be combined.

In accordance with the provisions of the patent statutes, the present invention has been described in what is considered to represent its preferred embodiment. However, it should be noted that the invention can be practiced otherwise than as specifically illustrated and described without departing from its spirit or scope.

LIST OF REFERENCE SIGNS

1 elevator
3 elevator hoistway
5 elevator car
7 counterweight
9 suspension traction member
10 drive engine
11 drive unit
12 brake
13 elevator controller
15 power source
17 safety switches
19 landing door switches
20 safety chain
21 landing door
23 ladder presence switch
25 ladder
27 car door
29 car door switch
31 safety chain overlay control unit
33 floor
35 electrical connection
37 electric line
41 main contactor
43 safety PLC
47 first connectors
48 second connectors
49 contactors
51 third connectors
53 safety relay
55 door zone switches
57 main power supply unit
59 uninterruptible power supply
61 manual start button
63 status indication
65 safety relay
67 tab to safety chain

The invention claimed is:

1. An elevator comprising:

a drive unit for displacing an elevator car in an elevator hoistway;

an elevator controller for controlling an operation of components of the drive unit;

multiple safety switches being switchable upon occurrence of safety relevant events related to the elevator;

a safety chain overlay control unit including a safety programmable logic controller (PLC);

wherein the safety PLC includes first connectors connected to contacts of at least one first safety switch of the safety switches being one of a single first safety switch or a plurality of first safety switches connected in series to form a first safety chain;

wherein the safety PLC includes second connectors connected to contacts of at least one second safety switch of the safety switches being one of a single second safety switch or a plurality of second safety switches connected in series to form a second safety chain;

wherein the safety PLC is adapted for monitoring a current safety status of the elevator and identifying a safety critical status of the elevator based on detecting when at least one of the at least one first safety switch and the at least one second safety switch changes its switching state and based on comparing a current switching state of the at least one first safety switch with a current switching state of the at least one second safety switch; and wherein the safety PLC is adapted to cause interruption of a power supply to the drive unit upon identifying the safety critical status of the elevator.

2. The elevator according to claim 1 wherein the switching state of the at least one first safety switch and the switching state of the at least one second safety switch are correlated in a predetermined correlation manner due to structural characteristics of the elevator components and wherein the safety PLC takes into account such predetermined correlation manner upon identifying the safety critical status of the elevator.

3. The elevator according to claim 1 wherein the at least one first safety switch includes a car door switch and the at least one second safety switch includes a plurality of landing door switches connected in series to form the second safety chain.

4. The elevator according to claim 1 wherein:

the elevator car includes at least one car door provided with a car door switch;

the elevator hoistway includes a plurality of landing doors, each of the landing doors having a landing door switch;

the safety PLC includes at least one pair of first connectors being connected to contacts of the car door switch;

the safety PLC includes at least one pair of second connectors being connected to end contacts of a safety chain having the landing door switches connected in series; and the safety PLC is adapted to monitor the current safety status of the elevator and identify the safety critical status of the elevator based on detecting when at least one of the car door switch and at least one the landing door switches changes its switching state and based on comparing a current switching state of the car door switch with a current switching state of the at least one landing door switch.

5. The elevator according to claim 1 wherein:

the elevator car includes at least two car doors, each of the car doors being provided with a car door switch;

the elevator hoistway includes a plurality of landing doors, each of the landing doors having a landing door switch, the landing door switches associated with at least one set of the landing doors being connected in series forming a set safety chain;

the safety PLC includes at least two pairs of first connectors, each of the pairs of first connectors being connected to contacts of one of the car door switches; and the safety PLC includes at least one pair of second connectors being connected to end contacts of the set safety chain.

6. The elevator according to claim 5 wherein a number of the pairs of the first connectors corresponds to a number of the car doors and wherein a number of the pairs of the second connectors corresponds to a number of set safety chains formed from the landing doors.

7. The elevator according to claim 1 wherein the safety chain overlay control unit includes at least one door zone switch connected to the safety PLC, the at least one door zone switch being adapted to determine a door zone presence status and communicate the door zone presence status to the safety PLC, the door zone presence status indicating whether or not the elevator car is presently in a predetermined door zone within the elevator hoistway.

8. The elevator according to claim 7 wherein the safety PLC is adapted to take into account the door zone presence status when identifying the safety critical status of the elevator.

9. The elevator according to claim 7 wherein, while the elevator car is in the predetermined door zone, a car door of the elevator car and a neighboring landing doors in the elevator hoistway are mechanically coupled to move synchronously, and wherein the safety PLC is adapted to, when the door zone presence status is indicating that the elevator car is currently in the predetermined door zone within the elevator hoistway, monitor the current safety status of the elevator and identify the safety critical status of the elevator based on comparing the current switching state of the first safety switch being implemented as the car door switch with the current switching state of the first safety chain of landing door switches including a landing door switch associated with the neighboring landing door.

10. The elevator according to claim 1 wherein the safety chain overlay control unit further comprises a main power supply unit providing electric power to the safety PLC and an uninterruptible power supply providing electric power stored in the uninterruptible power supply to the safety PLC upon failure of the main power supply unit to provide the electric power.

11. The elevator according to claim 1 wherein the safety PLC is adapted to, upon monitoring the current safety status of the elevator, apply a pulsed voltage to the safety switches.

12. The elevator according to claim 1 wherein the safety PLC is adapted to fulfill at least safety-integrity-level-2 (SIL-2) requirements.

13. The elevator according to claim 12 wherein the safety PLC is adapted to fulfill safety-integrity-level-3 (SIL-3) requirements.

14. The elevator according to claim 1 comprising:

the elevator car having at least one car door provided with a car door switch being the at least one first safety switch;

a plurality of landing doors in the elevator hoistway, each of the landing doors provided with a landing door switch, the landing door switches being the at least one second safety switch;

wherein the safety PLC has a pair of the first connectors connected to contacts of the car door switch;

wherein the safety PLC has at least one pair of the second connectors connected to end contacts of the second safety chain that includes the landing door switches connected in series;

wherein the safety PLC identifies the safety critical status of the elevator based on detecting when at least one of the car door switch and the landing door switches changes its switching state and based on comparing a current switching state of the car door switch with a current switching state of the landing door switches;

wherein the safety PLC is adapted to cause interruption of a main power supply to the drive unit upon identifying the safety critical status of the elevator;

wherein the switching state of the car door switch and the switching state of the landing door switches are correlated in a predetermined correlation manner due to structural characteristics of elevator components and wherein the safety PLC takes into account the predetermined correlation manner upon identifying the safety critical status of the elevator;

wherein the safety chain overlay control unit includes at least one door zone switch connected to the safety PLC, the at least one door zone switch being adapted to determine a door zone presence status and communicate the door zone presence status to the safety PLC, the door zone presence status indicating whether or not the elevator car is presently in a predetermined door zone within the elevator hoistway;

wherein the safety PLC is adapted to take into account the door zone presence status when identifying the safety critical status of the elevator; and wherein, while the elevator car is in the predetermined door zone, the at least one car door and a neighboring one of the landing doors are mechanically coupled to move synchronously and wherein the safety PLC is adapted to, when the door zone presence status is indicating that the elevator car is currently in the predetermined door zone within the elevator hoistway, monitor the current safety status of the elevator and identify the safety critical status of the elevator based on comparing the current switching state of the car door switch with the current switching state of the second safety chain including the landing door switch associated with the neighboring landing door.

15. A method for modernizing an existing elevator, the elevator including a drive unit for displacing an elevator car in an elevator hoistway, an elevator controller for controlling an operation of components of the drive unit, and multiple safety switches being switchable upon occurrence of safety relevant events related to the elevator, the method comprising:

providing a safety chain overlay control unit according to claim 1;

connecting the first connectors of the safety PLC to contacts of the at least one first safety switch; and connecting the second connectors of the safety PLC to contacts of the at least one second safety switch.

16. A safety chain overlay control unit for an elevator, the elevator including a drive unit for displacing an elevator car in an elevator hoistway, an elevator controller for controlling an operation of components of the drive unit, multiple safety switches being switchable upon occurrence of safety relevant events related to the elevator, the safety chain overlay control unit comprising:

a safety PLC;

wherein the safety PLC includes first connectors connectable to contacts of at least one first safety switch of the safety switches being one of a single first safety switch and a plurality of first safety switches connected in series to form a first safety chain;

wherein the safety PLC includes second connectors connectable to contacts of at least one second safety switch of the safety switches being one of a single second safety switch and a plurality of second safety switches connected in series to form a second safety chain;

wherein the safety PLC is adapted to monitoring a current safety status of the elevator and identifying a safety critical status of the elevator based on detecting when at least one of the at least one first safety switch and the at least one second safety switch changes its switching state and based on comparing a current switching state of the at least one first safety switch with a current switching state of the at least one second safety switch; and wherein the safety PLC is adapted to cause interruption of a main energy supply to the drive unit upon identifying the safety critical status of the elevator.

* * * * *